US007296805B2

(12) United States Patent
Lindemann

(10) Patent No.: US 7,296,805 B2
(45) Date of Patent: Nov. 20, 2007

(54) SNOWBOARD BINDING

(76) Inventor: Carl T. Lindemann, 521 Cottonwood Dr., Vallejo, CA (US) 94591

( * ) Notice: Subject to any disclaimer, the term of this patent is extended or adjusted under 35 U.S.C. 154(b) by 0 days.

(21) Appl. No.: 11/284,624

(22) Filed: Nov. 23, 2005

(65) Prior Publication Data

US 2007/0114737 A1 May 24, 2007

(51) Int. Cl.
*B62B 13/00* (2006.01)

(52) U.S. Cl. ..... 280/14.22; 280/14.21; 280/613

(58) Field of Classification Search ..... 280/14.22, 280/14.21, 14.24, 607, 618, 617, 624, 629, 280/628, 613, 11.3; 482/71, 70, 146
See application file for complete search history.

(56) References Cited

U.S. PATENT DOCUMENTS 5,188,386 A * 2/1993 Schweizer ..... 280/607
6,296,258 B2 * 10/2001 Higgins et al. ..... 280/14.22
6,336,650 B1 * 1/2002 Alspaugh ..... 280/613
6,491,310 B1 * 12/2002 Work ..... 280/14.24
6,604,746 B1 * 8/2003 Sato et al. ..... 280/14.22
6,655,700 B1 * 12/2003 Caputo et al. ..... 280/14.22
6,767,313 B2 * 7/2004 Sayce ..... 482/71
7,097,195 B2 * 8/2006 Orr et al. ..... 280/628
2001/0001520 A1 * 5/2001 Gyr ..... 280/14.22
2001/0010422 A1 * 8/2001 Merino et al. ..... 280/624
2002/0024187 A1 * 2/2002 Gyr ..... 280/14.22
2004/0041365 A1 * 3/2004 Humbel ..... 280/618
2004/0232656 A1 * 11/2004 Gyr ..... 280/617

* cited by examiner

*Primary Examiner*—Hau Phan
(74) *Attorney, Agent, or Firm*—Paul R. Martin

(57) ABSTRACT

A binding for a snowboard or other type of board that has a base plate structure formed of a lower plate that is mountable on a board; an upper plate that is adapted to receive a boot and is mounted above the lower plate in a spaced relationship; and a spring-based suspension system connecting the upper plate to the lower plate. The suspension system has a plurality of springs, one spring being connected between a flange of the upper plate and a corresponding flange on the lower plate. A boot attachment apparatus is connected to the base plate structure.

8 Claims, 5 Drawing Sheets

SNOWBOARD BINDING

BACKGROUND OF THE INVENTION

1. Field of the Invention

This invention pertains generally to snowboard bindings, and more particularly to snowboard bindings designed to absorb vibration and shock.

2. Description of Related Art

Snowboarding has rapidly become a popular winter sport, competing with skiing. Various types of equipment have been developed, to facilitate the enjoyment of the sport by all participants, from beginners to experts.

The binding, by which the boot is affixed to the board, is an important element. In addition to the terrain and snow conditions, as well as the ability of the rider, the combination of boot, binding, and board greatly influence the type of ride that the snowboarder will experience. The bindings connect the snowboarder to the board and allow the snowboarder to maneuver the board during a ride down a slope.

The snowboard is controlled by weight transfer and foot movement of the rider. Edge control is important to carve turns rather than just slide through the snow. It is desirable to improve the riders feel for the board and to increase the board's responsiveness to the riders foot movement. It is generally desirable to provide a secure attachment to the board, while at the same time providing some medial and lateral ankle mobility. The system should provide for vibration and shock absorption to provide a more comfortable ride, and allow the board to flex properly as it traverses the terrain. The system should of course be as lightweight as possible, safe, and adjustable, both for a single user for different conditions, and for multiple users.

The rider's feel for the board, and the board's responsiveness to the rider's foot movements, are increased by keeping the snowboarder's feet close to the board. Secure attachment of the boot to the board improves safety, in particular by allowing the efficient transfer of forces between the rider and the board, which aids the rider in controlling the board. Some medial and lateral ankle mobility is helpful for maneuvering the board. Riding over hard-packed or rough terrain, particularly at high speeds, is improved by vibration damping or absorption, and jumps and stunts are improved by shock absorption.

Of course, in addition to the bindings, a variety of different boots and boards are also available. These also affect the snowboarding experience.

Thus, a wide variety of different bindings have been developed that incorporate features designed to address various of these problems and objectives. The goal is to provide a boot-binding-snowboard system so that riders of different levels, facing a variety of different conditions, can enjoy an optimum experience by selecting a system which matches the rider's ability to the rider's performance objectives.

In particular, the problem of vibration or shock damping or absorption is generally dealt with by providing some type of elastomeric pads between the boot and the board, usually as part of the binding, but sometimes also on the bottom of the boot. However, the materials used are exposed to harsh conditions and have a limited lifetime. Thus it is desirable to find a different and better way to provide vibration and shock damping and absorption.

BRIEF SUMMARY OF THE INVENTION

An aspect of the invention is a snowboard binding having a base plate structure formed of a lower plate that is mountable on a snowboard; an upper plate that is adapted to receive a boot and is mounted above the lower plate in a spaced relationship; and a spring-based suspension system connecting the upper plate to the lower plate. The suspension system has a plurality of springs, one spring being connected between a flange of the upper plate and a corresponding flange on the lower plate. A boot attachment apparatus is connected to the base plate structure.

Further aspects of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 5. It will be appreciated that the apparatus may vary as to configuration and as to details of the parts, without departing from the basic concepts as disclosed herein.

The invention applies to a snowboard-binding-boot system designed to damp or absorb vibration or shock. The invention is directed to a snowboard binding having a base plate structure formed of an upper plate and a lower plate separated by a plurality of springs. The springs are mounted in any manner that allows the top plate to be pushed down, thereby compressing the springs, when weight is redistributed on or additional force is applied to the top plate. The springs act as shock absorbers.

Figure 1:
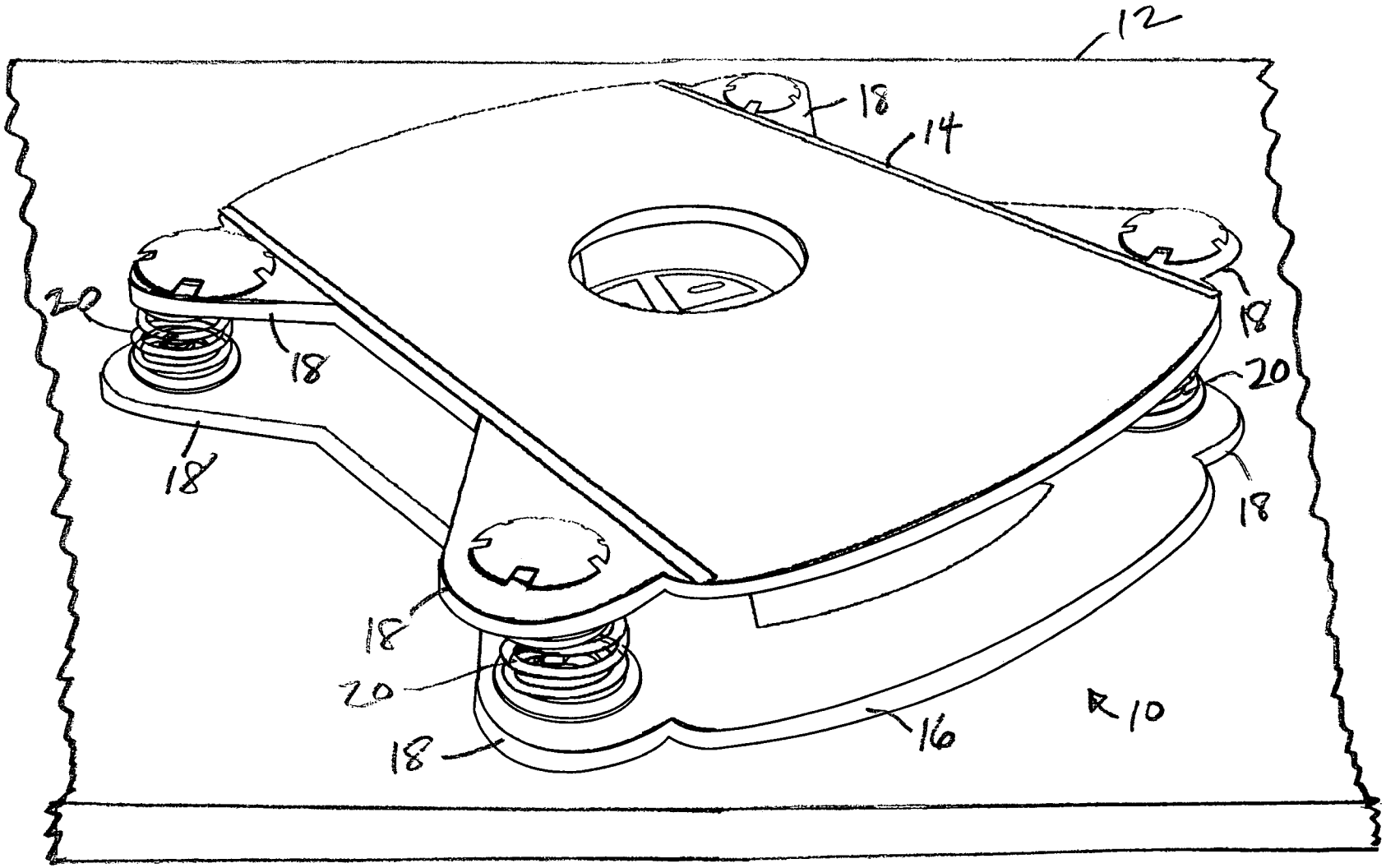
FIG. 1 is a perspective view of the basic base plate structure of the binding according to the invention mounted on a board.

FIG. 1 shows a base plate structure 10 of the invention. Base plate structure 10 is mounted on a snowboard 12. Base plate structure 10 is formed of an upper or top plate 14, on which a boot will sit, and a lower or bottom plate 16, which is attached to the board 12.

Each of upper and lower plates 14, 16 are substantially rectangular or elongated in shape and have a pair of flanges 18 extending from each lateral side thereof, typically near the front and rear of each lateral side. The flanges 18 generally extend outside the area over which the boot will sit. When the upper plate 14 is mounted over lower plate 16 in base plate structure 10, each flange 18 of the upper plate 14 will be substantially aligned with a corresponding flange 18 of the lower plate 16. A spring 20 is mounted between each of the four pairs of corresponding upper and lower flanges 18 so that upper plate 14 can move relative to lower plate 16 by compression and expansion of the springs 20.

Figure 2:
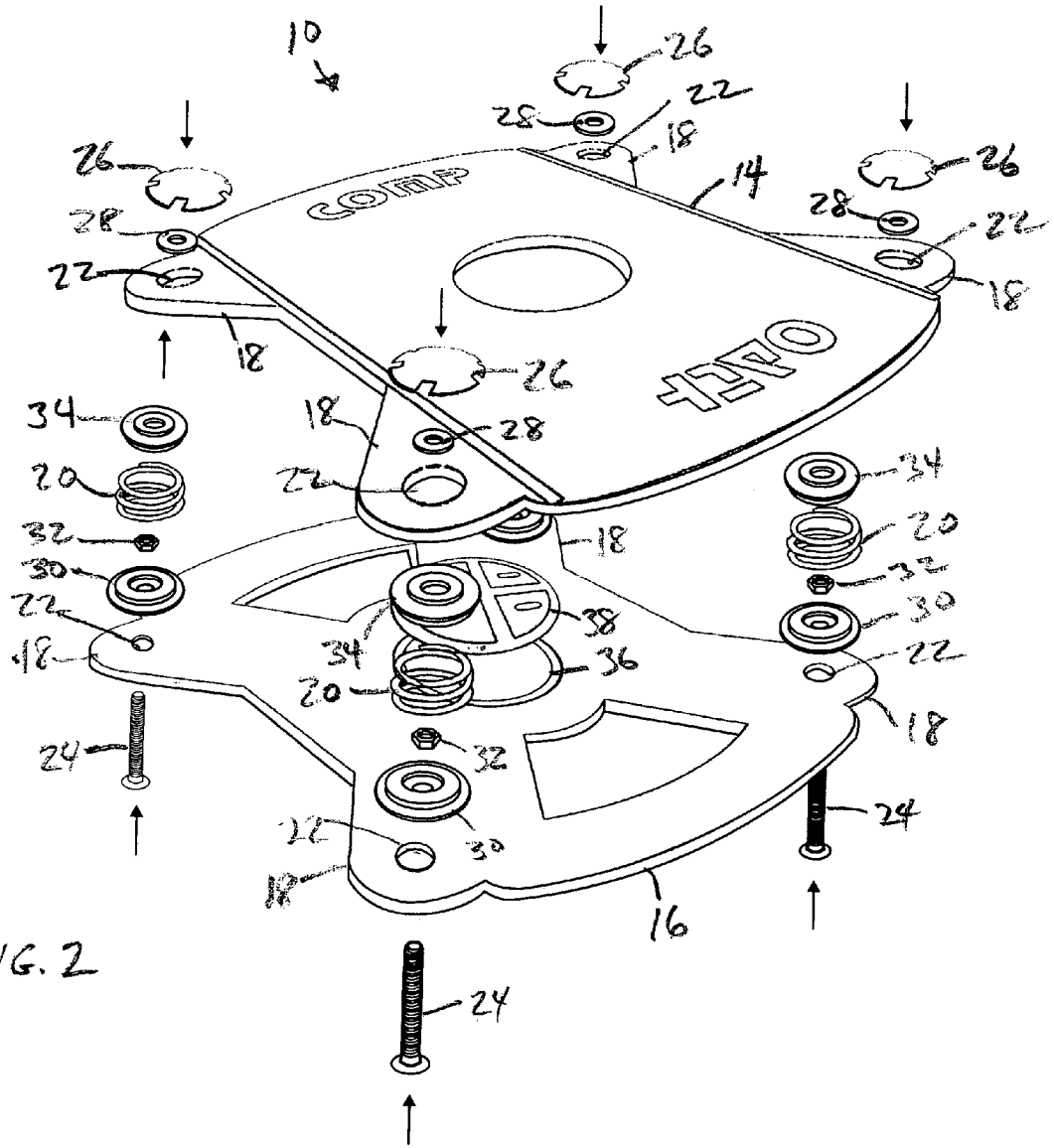
FIG. 2 is an assembly drawing of the base plate structure of FIG. 1.

FIG. 2 shows the details of mounting the springs 20 between upper plate 14 and lower plate 16. (Similar parts have the same identifying numbers.) Each flange 18 extending from the upper and lower plates 14, 16 has an aperture 22 formed therein. The apertures 22 of upper plate 14 align with corresponding apertures 22 of lower plate 16.

A bolt 24 passes upwards through an aperture 24 in lower plate 16 and through the corresponding aligned aperture 22 of the upper plate 14, where it is secured to a top cap 26, e.g. top cap 26 screws onto the distal end of bolt 24. A washer 28 is placed between the end cap 26 and flange 18 with the bolt 24 passing through the washer 28.

Surrounding the bolt 24 between the lower plate 16 and upper plate 14 are a lower spring seat 30, a nut 32, the spring 20, and an upper spring seat 34. Nut 32 is tightened down, with lower spring seat 30 underneath, so that one end of bolt 24 is secured to the bottom plate 16, i.e. the lower plate 16 cannot move relative to bolt 24.

Lower spring seat 30 and upper spring seat 34 form seats at the lower and upper flanges 18 respectively for the ends of spring 20, i.e. they are shaped to engage the ends of the springs 20. As a result, the springs are kept in a substantially vertical orientation; otherwise they would tend to tilt in operation. An alternate way of seating springs 20 in the binding plate structure 10 is to have the ends of the springs 20 extend into recesses formed in the upper and lower plates 14, 16.

When there is no weight on the upper plate 14, the spring tension forces the upper plate 14 apart from lower plate 16. Bolt 24 defines the maximum separation between plates 14, 16. End caps 26 prevent the plate 14 from moving any farther, i.e. the plate 14 is pushed by spring 20 into contact with end cap 26.

However, the upper plate 14 can move relative to bolt 24 (and end cap 26). When weight is applied to top plate 14, plate 14 is pushed down, compressing spring 20. Plate 14 can move down away from end cap 26 and slide down along bolt 24 when weight is applied. The flanges 18 extend outside the footprint of the boot so that upper plate 14 can compress the springs 20 and move downwards along the bolts 24, i.e. the bolt 24 will extend upwards alongside the boot.

The distance down that the plate 14 will move will be determined by the weight applied and by the spring force. If the weight is applied uniformly, then plate 14 will move uniformly down on all the springs. However, weight can be applied unevenly, e.g. along one side or at just one corner, during particular maneuvers. Then the compression will be uneven. The springs are generally chosen for a particular rider so that the upper plate will be at its topmost position. The springs will then allow for weight redistribution, and absorb vibrations of the board and shocks produced by impact on the board, e.g. during jumps or other stunts.

Of course the springs 20 will be relatively short and relatively stiff to limit the amount of motion available. A typical spacing between the upper and lower plates 14, 16 is about 1 to about 1½ inches.

Bottom plate 16 contains a central aperture 36 and a central cap 38. These are used in a conventional manner to mount or affix the bottom plate 16 to the board, and also to allow adjustment of the binding position, i.e. to rotate the plate 16 to be positioned at a different angle to the length of the board. Other apertures in the plates 14, 16 are merely to reduce weight.

Figure 3:
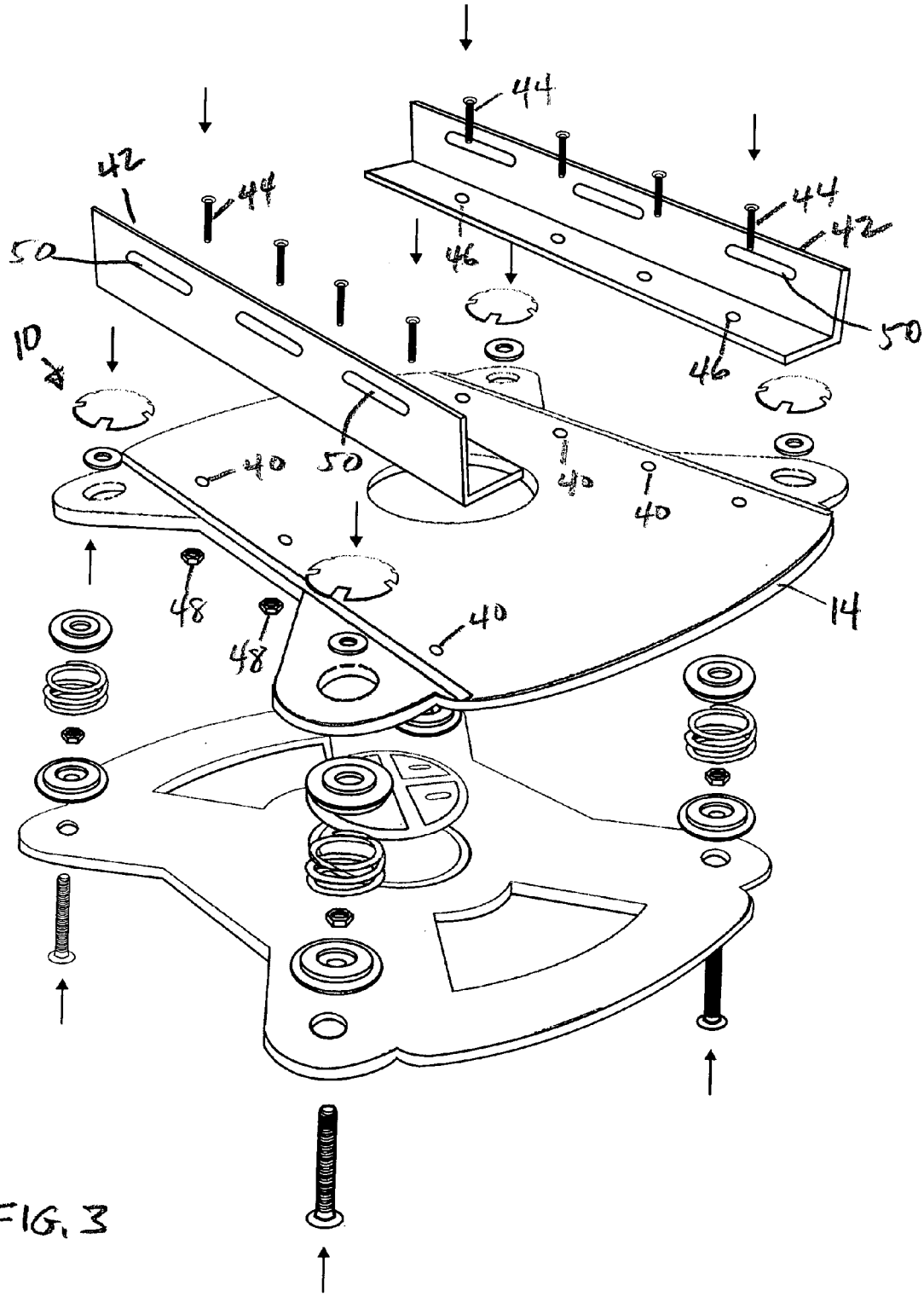
FIG. 3 is an assembly drawing of the base plate structure of FIGS. 1-2 with additional lateral brackets for holding a boot.

FIG. 3 is similar to FIG. 2 (most of the elements are identical and are not numbered), but includes a pair of lateral brackets 42 mounted on top plate 14 of base plate structure 10. Brackets 42 are L-shaped and are secured to top plate 14 by bolts 44 passing through apertures 46 in the horizontal portion of the bracket 42, and through aligned apertures 40 in top plate 14. The distal ends of bolts 44 are secured with nuts 48.

Lateral brackets 42 extend along the two lateral edges of top plate 14 and provide a support structure for laterally holding the boots. The vertical portion of the bracket 42 contains a plurality of horizontal slots 50, which may be used to secure other components of the binding.

Figure 4:
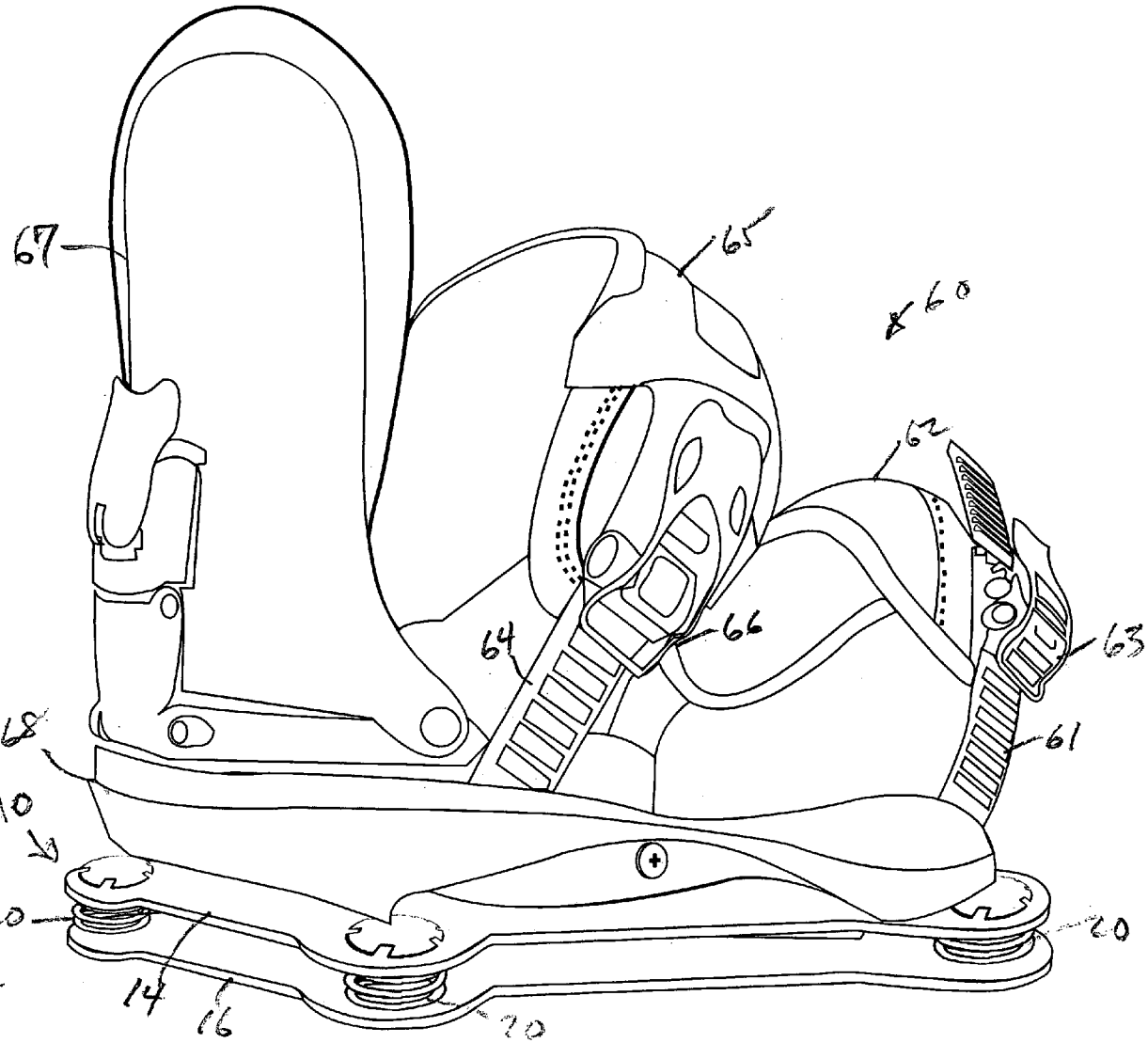
FIG. 4 is a perspective view of a boot strapped to a binding having the base plate structure of FIGS. 1-2.
Figure 5:
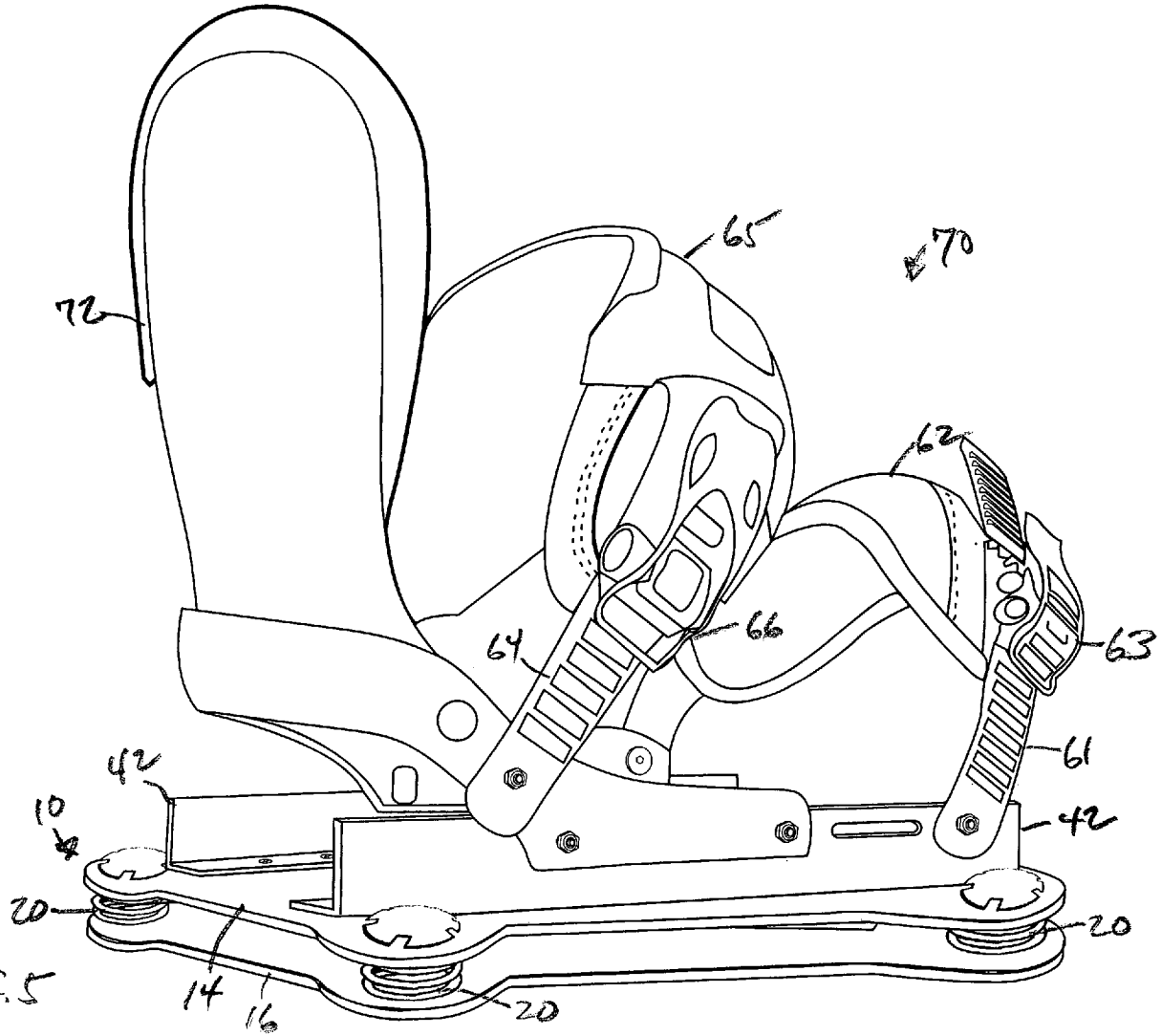
FIG. 5 is a perspective view of a boot strapped to a binding having the base plate structure of FIG. 3.

The base plate structure 10 with its spring-based suspension system connecting the upper and lower plates 14, 16, forms the basis of the binding for a snowboard. The remainder of the binding comprises the boot attachment apparatus; any conventional components for attaching a boot to the binding can be used. FIGS. 4-5 illustrate two examples.

FIG. 4 shows a binding 60 of the invention that has the base plate structure 10 of FIGS. 1-2. Binding 60 has a front or toe strap 61 connected to a toe cap 62 with a tensioning and release buckle 63, and a mid-boot strap 64 connected to mid-boot retainer 65 with a tensioning and release buckle 66. Binding 60 also has a heel portion 67. The heel portion 67 and the straps 61, 64 are connected to a base portion 68 which is mounted on the top plate 14.

A boot fits into binding 60 with the heel against heel portion 67. Toe cap 62 and mid-boot retainer 65 are tightened against the boot by buckles 63, 66 on straps 61, 64 respectively.

FIG. 5 shows a binding 70 of the invention that has the base plate structure 10 of FIGS. 1-2 and the lateral brackets 42 of FIG. 3. Binding 70, similar to binding 60, has a front or toe strap 61 connected to a toe cap 62 with a tensioning and release buckle 63, and a mid-boot strap 64 connected to a mid-boot retainer 65 with a tensioning and release buckle 66. Binding 60 also has a heel portion 72. The heel portion 72 and the straps 61 are connected to the lateral brackets 42, which are mounted on the top plate 14. Straps 64 are connected to the heel portion 72. A boot fits into binding 70, held between heel portion 72 and lateral brackets 42, by toe cap 62 and strap 61 and mid-boot retainer 65 and strap 64.

The invention thus provides a snowboard binding which damps or absorbs vibration and shock. The compression and expansion of the springs between the upper and lower base plates provides the mechanism.

While this invention has been described in terms of a snowboard binding, the binding is also suitable for use in conjunction with other types of boards, such as wakeboards, or similar boards where it is desirable to provide for dampening of vibration, and shock absorption. Thus, in its broadest context, the invention is a binding for any type of board where it is necessary or desirable to reduce vibration and absorb shock.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

What is claimed is:

1. A binding for a snowboard or other type of board, comprising:

a base plate structure comprising:

a lower plate that is mountable on a board;

an upper plate that is adapted to receive a boot and is mounted above the lower plate in a spaced relationship;

the upper and lower plates each comprising a plurality of flanges extending outwards from a footprint area of the plates, the flanges of the upper plate being aligned with corresponding flanges of the lower plate, each flange having an aperture formed therethrough;

a spring-based suspension system connecting the upper plate to the lower plate, comprising:

a plurality of springs, one spring extending between each flange of the upper plate and its corresponding flange on the lower plate, with the ends of each spring being substantially in contact with the flanges of the upper and lower plates;

a plurality of bolts, one bolt extending upwardly through each aperture of each flange of the lower plate and being fixedly mounted thereto, each bolt non-fixedly passing through the corresponding aperture of the upper plate, a spring around each bolt;

an end cap attached to the distal end of each bolt above the upper plate so that when there is no weight on the upper plate the springs force the upper plate up against the end caps and when weight is applied to the upper plate, the upper plate can compress the springs and move down relative to the bolt away from the end caps;

wherein the spring-based suspension system is compressed by the application of force and thereby absorbs vibration and shock.

2. The binding of claim 1 further comprising spring seats engaging each end of each spring.

3. The binding of claim 1 further comprising a pair of lateral brackets mounted on the top of the upper plate, one along each lateral edge, inside the laterally extending flanges.

4. The binding of claim 1 further comprising a boot attachment apparatus connected to the base plate structure.

5. The binding of claim 4 wherein the boot attachment apparatus comprises:

a heel portion;

a toe retainer apparatus;

a mid-boot retainer apparatus.

6. The binding of claim 5 wherein the toe retainer apparatus comprises a toe retainer, a strap connecting the toe retainer to the binding, and a tensioning and releasing buckle in the strap.

7. The binding of claim 6 wherein the mid-boot retainer apparatus comprises a mid-boot retainer, a strap connecting the mid-boot retainer to the binding, and a tensioning and releasing buckle in the strap.

8. The binding of claim 5 further comprising a pair of lateral brackets mounted on the top of the upper plate, one along each lateral edge, inside the laterally extending flanges.

* * * * *